US005957458A

United States Patent [19]

Haas et al.

[11] Patent Number: 5,957,458

[45] Date of Patent: Sep. 28, 1999

[54] SUBSTRATE WITH HIDDEN IMAGES AND METHOD OF MAKING SUCH IMAGES APPEAR

[75] Inventors: David J. Haas, Suffern; Robert Holt, Cornwall-on-Hudson, both of N.Y.

[73] Assignee: Temtec, Inc., Suffern, N.Y.

[21] Appl. No.: 09/033,773

[22] Filed: Mar. 3, 1998

Related U.S. Application Data

[60] Provisional application No. 60/041,001, Mar. 3, 1997.

[51] Int. Cl.[6] ..... A63F 3/06

[52] U.S. Cl. ..... 273/269; 273/139

[58] Field of Search ..... 273/139, 269, 273/292, 293, 295

[56] References Cited

U.S. PATENT DOCUMENTS

| | | | |
|---|---|---|---|
| 3,493,230 | 2/1970 | Curzon | 273/269 X |
| 3,495,700 | 2/1970 | Chandos | 273/269 X |
| 3,826,499 | 7/1974 | Lenkoff | 273/269 X |
| 4,212,468 | 7/1980 | Knott | 273/269 X |
| 4,877,253 | 10/1989 | Arens | 273/269 X |
| 5,560,610 | 10/1996 | Behm et al. | 273/269 |
| 5,593,160 | 1/1997 | Constantine et al. | 273/139 |
| 5,641,167 | 6/1997 | Behm et al. | 273/139 X |

*Primary Examiner*—William E. Stoll
*Attorney, Agent, or Firm*—Michael E. Zall

[57] ABSTRACT

A game card having a hidden game image thereon that is developed over a predetermined period of time. The game card includes a front part and a rear part. The rear part has a migrating ink pattern layer overlaying a rear support member to form a game image. An non-migrating printed pattern layer overlays the rear support member to form a confusion pattern to hide the image. The front part includes a front support layer having an adhesive layer on one side and a front ink display surface on the other side. The adhesive layer is capable of causing the migrating ink pattern to migrate upon contact therewith. Thus when the front part is contacted with the rear part by applying the adhesive layer onto the ink pattern layer, the adhesive layer activates the migration of ink in a selected time interval from the ink pattern layer, through the adhesive layer to the front ink display surface for viewing the game image. Typically, the game image is capable of informing the user whether the game card is a winning card or a losing card.

13 Claims, 1 Drawing Sheet

SUBSTRATE WITH HIDDEN IMAGES AND METHOD OF MAKING SUCH IMAGES APPEAR

RELATED APPLICATIONS

This application claims the benefit under 35 USC Section 119 (e) of Provisional Application No. 60/040,001 filed on Mar. 3, 1997 entitled METHOD OF MAKING HIDDEN IMAGES APPEAR ON PAPER. The entire disclosure of this provisional application is incorporated herein by reference.

BACKGROUND OF THE INVENTION

1. Field of the Invention

This invention relates to substrates, such as game cards and lottery tickets, with hidden images that are made to appear. There are many circumstances wherein it is desirable to print invisible indicia or areas on a paper substrate, and then make those areas visible in a simple and easy manner. Such a need exists in the production of educational forms, security documents, and game cards such as lottery tickets and promotional game cards.

2. Prior Art

Typically hidden images and the technology relating thereto are found in game cards that contain hidden play indicia such as numbers, symbols or messages that indicate whether or not the card is a winner or has a certain value to the player. The play indicia is normally covered by an opaque coating material, for example a latex compound which can be scratched off by the player to reveal the play indicia after the ticket has been purchased or otherwise obtained by the player.

Of importance to the game card industry and in particular the instant lottery industry is security. One method of breaching the security of game tickets is by candling, i.e., a bright light is applied to the game card in an effort to read the play indicia either through the latex covering or the back of the ticket. A number of techniques have been developed to counter candling including the use of a foil layer such as aluminum foil as part of the game ticket. This foil layer blocks visible light and therefore makes it virtually impossible to read the play indicia through the opaque coating. However the use of a foil layer has a number of significant disadvantages including higher costs and recycling problems.

Another approach to prevent candling is to imprint confusion patterns on the ticket. A confusion pattern obscures or otherwise confuses the image of the play indicia when visible light is shined through the game card thus making it difficult or impossible to read the indicia before the latex covering is removed. Confusion patterns may be printed on the back of a lottery ticket. Although confusion patterns printed on the back of the ticket help to prevent candling, other methods exist for compromising the security of the ticket. For example, delamination can be used to overcome the security provided by confusion patterns printed on the back of the ticket. The back ticket layer containing the confusion layer is separated or delaminated from the ticket. Once delaminated, the indicia can be read by candling.

Confusion patterns consisting of irregular opaque areas have also been printed on the top surface of the card stock below the opaque mask. In another technique, to prevent photocopying through the opaque mask, a confusion pattern is printed over the play indicia using a transparent media or a media having a color differing from the color of the play indicia so that the confusion pattern will not obscure the play indicia when the opaque mask is removed by a player. Another confusion pattern is then printed below the play indicia on the card material immediately below the play indicia. One disadvantage of this approach is that unless the upper confusion pattern is completely transparent its existence will be apparent to those individuals who may be considering methods for breaching game card security. In addition the upper confusion pattern as described makes very little contribution to the prevention of candling.

Wicking is another technique that has been used to read the play indicia without having to remove the opaque mask. In wicking a solvent containing alcohols, ketones, acetate, esters, aliphatic or amine solutions is applied to either the back or the front of the game card resulting in the bleed through of an image of the play indicia. This makes it possible to determine if a game card is a winner before the opaque coating is removed. One approach to prevent wicking to place solvent responsive dyes in the opaque coating.

Other more exotic techniques may be used for improperly reading hidden images. For example, microscopic spectrophotometry with a computer controlled stepping stage can be used to map out differences in optical properties between the inks. Filtered light either reflected (including white and dark field) and transmitted light may also be used. Polarized light might also reveal differences between the inks. Other types of microscopic techniques might reveal differences, e.g. Tunneling Electron Microscope (TEM), Scanning Electron Microscope, (SEM) and Atomic Force Microscope (ATM) are some examples.

Additionally, by looking at the material absorption with x-rays, the composition of the different inks might be determined. By detecting which ink dots are of one composition and a second type of ink dots are of a second composition. It doesn't matter what the actual composition is, as long as they are different. By using various analytical techniques such as Neutron Activation Analysis, x-ray fluorescence, electron beam fluorescence, and various other two-dimensional techniques, one could plot the responses as to each ink dot composition and hence, map out the hidden image within the printing.

Still further, by placing a material such as plasticized vinyl, oilpaper, and polyester under heat in direct contact with the back part ink, one may be able to absorb out of the ink enough dye to make the image legible.

Any substrate bearing a hidden image, particularly a game card or lottery ticket, must be able to withstand most if not all of these methods of improperly viewing the hidden image.

The aforedescribed techniques and other techniques for hiding images on printed documents are particularly useful for the production of printed materials for promotion, advertising, game, and novelty devices. One common feature of all of these techniques for hiding images, be it hiding a printed message under a paper cover, label, removable opaque coating or layer, e.g., "Scratch-Off" coating, is that once the opaque layer is removed, the information appears instantly.

Known U.S. Patents relevant to these techniques are: U.S. Pat. No. 5,012,318 to Mayo et al; U.S. Pat. No. 5,213,648 to Vermeulan et al; U.S. Pat. No. 5,213,664 to Hansell; U.S. Pat. No. 5,215,576 to Carrick; U.S. Pat. No. 5,286,061 to Behm; U.S. Pat. No. 5,346,258 to Behm et al; U.S. Pat. No. 5,358,281 to Greig ; U.S. Pat. No. 5,368,334 to Christy et al; U.S. Pat. No. 5,532,046 to Rich et al; U.S. Pat. No. 5,542,710 to Silverschotz et al; U.S. Pat. No. 5,562,284 to Stevens;

and U.S. Pat. No. 5,569,512 to Brawner et al. Additionally, European No. 0 608 065 to Behm is also relevant to these known techniques. See also, for example various game card and instant lottery ticket constructions disclosed in U.S. Pat. Nos. 4,174,857, 4,273,362, 4,299,637, 4,725,079 and 4,726,608.

With respect to the more relevant references:

U.S. Pat. No. 5,286,061 to Behm describes validation data that is printed with a developable invisible ink capable of being rendered visible to determine if it is valid by application of a developing agent.

U.S. Pat. No. 5,346,258 to Behm et al describes a game card substrate wherein to enhance the security of the card a confusion pattern is printed with an ink that bleeds in the presence of a solvent that also causes the bleeding of the hidden play indicia.

U.S. Pat. No. 5,368,334 to Christy et al describes a security document having an invisible indicia of hydrophobic toner blended into the paper. The indicia is made visible by passing a conventional marker over it.

Time dependant security products, e.g., badges, are well known in the art. For example, see the following U.S. Patents and applications: U.S. Pat. No. 4,903,254 to Haas; U.S. Pat. No. 5,364,132 Haas et al.; U.S. Pat. No. 4,212,153 to Kydonieus et al.; U.S. Pat. No. 5,107,470 to Pedicano; U.S. Pat. No. 5,364,132 to Haas et al.; U.S. Pat. No. 5,446,705 to Haas et al; U.S. Pat. No. 5,058,088 to Haas; U.S. Pat. No. 4,432,630 to Haas; U.S. Pat. No. 4,542,982 to Haas; U.S. Pat. No. 4,779,120 to Haas; U.S. Pat. No. 5,719,828, to Haas (3.0-011/cip); U.S. Pat. No. 5,699,326, to Haas (3.0-013); U.S. Pat. No. 5,715,215, to Haas (3.0-015); U.S. Pat. No. 5,633,835, to Haas (3.0-017); U.S. Pat. No. 5,602,804, to Haas (3.0-019); U.S. Ser. No. 08/642,914 filed on May 6, 1996, now U.S. Pat. No. 5,822,280, to Haas (3.0-022); U.S. Ser. No. 08/718,268 to Frommer, et al filed Sep. 20, 1996 (3.0-024); and U.S. Ser. No. 08/613,316 filed on Mar. 11, 1996, now U.S. Pat. No. 5,785,354, to Haas (3.0-025).

None of these references teach or suggest the invention described herein.

OBJECTS SUMMARY OF THE INVENTION

It is an object of this invention to provide a time dependant game or promotion card that has a low cost and enhanced security by the use of specific type confusion patterns which permit the development of the hidden indicia over a period of time through the confusion pattern.

It is another object of the invention to provide a game card having an opaque coating covering a set of play indicia with a confusion pattern located above the play indicia such that the play indicia gradually bleed through the confusion pattern over a period of time to permit the viewing of the indica by a player.

The game card of this invention has a hidden game image or game indicia thereon that is developed over a predetermined period of time. The document comprises:

a front part and a rear part;

the rear part including:

a migrating ink pattern layer overlaying a rear support member to form a game image;

an non-migrating printed pattern layer overlaying the rear support member to form a confusion pattern to hide the image;

the front part including a front support layer having an adhesive layer on one side and a front ink display surface on the other side, the adhesive layer capable of causing the migrating ink pattern to migrate upon contact therewith. Thus when the front part is contacted with the rear part by applying the adhesive layer onto the ink pattern layer, the adhesive layer activates the migration of ink in a selected time interval from the ink pattern layer, through the adhesive layer to the front ink display surface for viewing the game image.

The game card image or indicia, e.g., play indicia, is hidden by a confusion pattern that hides the printed information, making it invisible to the eye camouflaged by other printing surrounding the actual message to be presented. The game card permits the indicia or image to gradually change or appear over a predetermined time interval.

Such a game card can provides many benefits to the distributor of such cards. For example, it may cause the viewer or game player to wonder over the period of time for development, what the information is disclosed in the indicia. It provokes the viewers interest in the device and/or message being conveyed; the card can present several answers at different time intervals, thus increasing the interest in the printing; the card can make the image appear out of nowhere in a magical fashion. The indicia can be made visible to the viewer from the initial viewing but it is not legible or understandable until the viewer activates the card with a self-adhesive sticker to permit the indicia or image to fully appear over the predetermined period of time.

The game card or "image change paper" of this invention is a novel printing technology that enables the image or indicia, e.g., words, to appear at different times, e.g., minutes, hours, days. The image change paper is activated by placing a self-adhesive activation cover (front part) on top of a printed pattern (back part) that contains the hidden indicia, message or image. As soon as the two parts are together, the game card is "activated", and the image appearing process begins. The words or image become legible after the time interval selected for the product. The timing control is dependent on the materials in the front part and back part of the game card.

The image is caused to appear through a dye migration system wherein the dyes migrates out of the printing ink on the backpart into the adhesive on the activation cover. As long as the front part and back part are kept separate from each other, nothing happens. But when the adhesive comes into contact with the printed pattern, the timing begins (for the appearance of the image) because the dyes begin to be dissolved immediately.

Specifically, image change paper is the development of self-appearing printing which only requires a pressure sensitive sticker to activate it. In practice, the ink printed pattern and the activation cover can be offered either on the same card or they can be supplied separately, depending on the particular promotion format.

The dynamic, time dependent nature of the image change paper of this invention in combination with the hiding or confusion technique used to hide the indicia or image clearly distinguish this invention from all other known game or promotion cards.

DETAILED DESCRIPTION OF THE INVENTION

Figure 1:
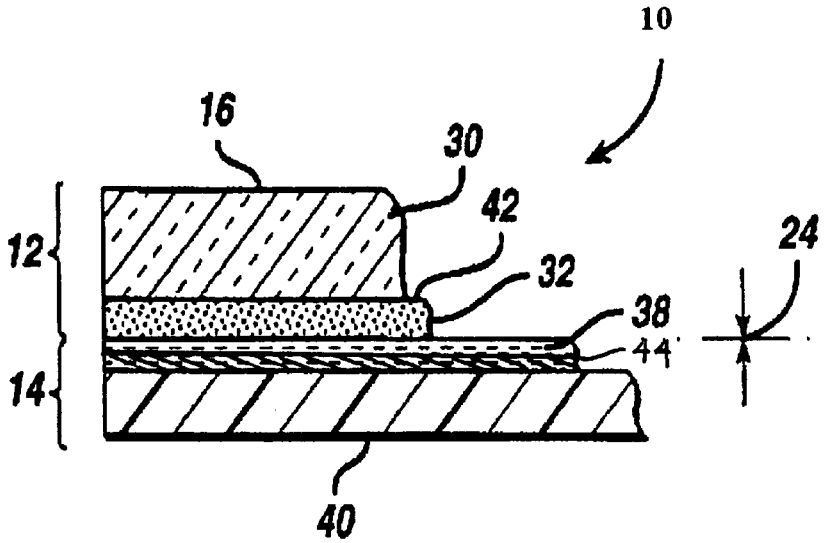
FIG. 1 is a schematic of a cross-section of a document, e.g., game ticket, of this invention.

FIG. 1, is an example of a game card 10 of this invention. Card 10 is assembled by the purchaser or recipient of the game card. The card 10 is made of two parts, a front part 12 being the face of the card and a back portion 14. An game indicia 44 is printed with a special ink that when activated by an adhesive 32 migrates through the opaque adhesive layer 32 to be viewed through the transparent front support layer 30 of the front part 12. Additionally, a non-migrating printed pattern layer 38 overlays the rear support member to form a confusion pattern to hide the game image 44. Thus, when the game card 10 is issued, the self-adhesive face or front portion 12 is placed over the back part 14 and the timing process begins. The ink 44 passes or migrates through the opaque adhesive layer 32 of the front part 12 within the predetermined time period whereupon the game image 38 becomes visible through the transparent front support layer 30, thus informing the purchaser or recipient of the game card whether they have a winning card.

The foregoing is only an example of the many configurations that may be used.

Techniques used in the time dependant security badge art may be used, either alone or in combination with each other, in the invention described herein. For example, see the following U.S. Patents and applications: U.S. Pat. No. 4,903,254 to Haas; U.S. Pat. No. 5,364,132 Haas et al.; U.S. Pat. No. 4,212,153 to Kydonieus et al.; U.S. Pat. No. 5,107,470 to Pedicano; U.S. Pat. No. 5,364,132 to Haas et al.; U.S. Pat. No. 4,432,630 to Haas; U.S. Pat. No. 4,542,982 to Haas; U.S. Pat. No. 4,779,120 to Haas; U.S. Pat. No. 5,719,828, to Haas (3.0-011/cip); U.S. Pat. No. 5,699,326, to Haas (3.0-013); U.S. Pat. No. 5,715,215, to Haas (3.0-015); U.S. Pat. No. 5,633,835, to Haas (3.0-017); U.S. Pat. No. 5,602,804, to Haas (3.0-019); U.S. Ser. No. 08/642,914 filed on May 6, 1996, now U.S. Pat. No. 5,822,280, to Haas (3.0-022); U.S. Ser. No. 08/718,268 to Frommer, et al filed Sep. 20, 1996 (3.0-024); and U.S. Ser. No. 08/613,316 filed on Mar. 11, 1996, now U.S. Pat. No. 5,785,354, to Haas (3.0-025). The entire disclosures of all of these patents and applications are incorporated herein by reference.

As used herein, the following terms will have the meaning indicated herein:

Activation Cover (Front Part)

The front part is used to activate or initiate the development of the latent image. The front part may be clear or opaque (white), a laminated material with pressure sensitive adhesive or may self-stick through other type attractive forces.

The Article

The entire construction of paper, plastic, etc that contains image change paper on it, e.g., the fully assembled game card.

Back Part

The portion of the article that usually contains the hidden image or printing.

Barrier Printing

Printing a coating over the hidden image produced from migrating inks or dyes, that blocks or prevents the migration of the dye or ink to prevent the formation of a viewable indicia, image or text.

Carrier Molecule (Organic Diffusion Molecule)

Any organic molecule, added to the activation cover, that speeds-up the image development by aiding in the dissolution of the migrating ink and/or increasing the rate of dye migration.

Confusion Pattern (Hiding Pattern/Camouflage Means)

Any pattern that is printed on the Back Part to obscure the image or indicia to produce a hidden image.

"Just" Detectable Image

The time required from the moment of activation until the eye can just detect that "something is there", whether readable or not.

Dot Printing

Printing the various inks as discrete dots with substantial white space between the dots.

Gray Time

The time between the visible image to develop from being "Just" Detectable to 50 to 100% detectable.

Hidden Image (Latent Image)

A non-legible printed indicia or image on the back part before activation of the image development by the activation cover. A latent image is an image that exists, even though you cannot see it.

Image Change Paper

A two part system comprising a Back Part that includes a hidden or latent printed image and a second part (Front Part) used to activate (develop) the image into a visible form.

Migrating Ink

Ink on the back part composed of dye(s) that migrates into the adhesive on the front part.

Mixed Dye Ink

Ink containing migrating and non-migrating dye. The migrating dye develops (migrates) out of the ink and may be of a different color than the original mixture.

Multiple Ink Dot Printing

Migrating and non-migrating ink printed at a random or uniform dot pattern to hide the latent image.

Non-Migrating Ink

Ink printed on the back part that does not contain migrating dye. It does not develop into an image.

Solid Printing

Printing the various inks as continuous lines/areas (images or text), not as course dots.

Visible Image

The legible image/picture/text presented to the observer after development by the Activation cover.

There are three basic concepts for image change paper. These will be expanded on more fully in the later sections.

Several Different (Back Part) Ink Printing Techniques for Image Change Paper

The special ink printed patterns can be printed in a number of forms, some, but not all are disclosed herein.

One technique of forming a hidden image on the back part is printing with two inks (one migrating, the other permanent) in a dot pattern with substantial white space between the dots. This is termed herein "the multiple ink dot printing technique". When the back part is activated by the front part, the adhesive on the front part touches all of the dots, however only the migrating ink dots grow and develop to reveal the image. The dot pattern may be a uniform array, or it may be random pattern, of any colors that match to hide the different inks.

A second printing technique is termed "the clear barrier ink printing technique". In this technique, the migrating ink is printed on the substrate in a uniform pattern and a clear barrier (coating) containing a design or pattern is printed over it. When activated, the adhesive touches only the exposed migrating ink and this exposed ink develops into the image.

Another printing technique employs either of the two above methods, but additionally overprints it with a clear or colored confusion pattern to hide the image printed below. The overprint ink is very thin or dilute so as not to block the migrating ink. When activated, the adhesive comes in contact with the migrating ink through the overprinted confusion pattern to cause the image to appear in the adhesive.

Still another printing technique employs either the first or second technique, additionally overprinted with a clear coating or a solid colored coating (not a confusion pattern)

to hide the image below. When activated, the adhesive (front part) releases a dissolving agent (carrier molecule) which penetrates the top coating (the hiding layer) and causes the image to appear in the adhesive.

Yet another printing technique employs chemically reactive dyes that change color upon being absorbed into the adhesive layer. These reactive dyes may be colored or colorless. The dyes may change color either because they react within the adhesive layer or an organic reactant diffuses from the adhesive into the printed ink on the back part.

Several Different (Front Part) Forms of Activation Covers for Image Change Paper The self-adhesive Activation covers may be of two basic forms:

One type of activation cover is a clear cover wherein the printing on the back part can be seen through the cover. Another type of cover is a white or opaque cover wherein the printing on the back part is obscured from the observer.

The activation covers may also contain an organic dissolving agent (carrier) that assists in making the color change very rapid, e.g., minutes. If the activation cover only consists of a cured adhesive and does not have an organic dissolving agent (carrier) or diffusing component, then one cannot use any of the printing techniques that require overprint barriers to be penetrated.

Several Different Temporal Results from Image Change Paper

The image development can be presented to the observer as simply a hidden message that appears rapidly within minutes ("hidden information function") or the image development can be made to appear over specific predetermined time intervals such as hours/days ("timing function"). It is also possible to make different portions of a single hidden message appear at different times.

The image change paper may be printed on flexographic and offset printing presses. It has been found that it is highly desirable, and perhaps even necessary, that the press or technique used to print the image change paper provide an ink that rapidly drys. This is necessary because if the clear offset ink vehicle spreads (creeps) before it fully dries, it may cause the migrating dye to travel with it and reveal images as each dot grows in size (the image is no longer hidden in the back part).

Additionally, it has been found that printing with offset oxidizing inks reveals the hidden image on uncoated (litho) thin stock when the paper is thin (20#, 60#). The image appears when the uncoated paper is label stock because as the vehicle soaks into the paper, it is not completely absorbed by the time it reaches the adhesive layer and the liner, so it spreads laterally. A thick stock paper absorbs the ink downward and does not spread laterally.

It has also been found that drying with heat is a problem because the heated and shows the image rapidly on the back part.

It has further been found, that printing with offset oxidizing inks on a thick (card) stock (8 mils or more) is satisfactory, because the ink drys as it soaks into the paper, before it begins to spread latterly. Drying with heat on thick card stock has not been a problem.

It has additionally been found that printing with offset oxidizing inks on coated stock can create a problem because the ink vehicle is not absorbed into the stock. Even though the image may not be visible immediately after printing, it will appear within hours/days as the ink creeps. Also, drying the ink with heat causes the image to appear immediately.

Printing of image change paper should be satisfactory with flexographic printing techniques that dry by evaporation or UV drying (curing), and with offset printing that employs UV drying.

Some inks do not perform as well as others. Inks that cure or polymerize will trap the migrating dye within the print. Inks that use a drier (catalyst) or other reactive ingredients have shown difficulties. This might be overcome with the use of an organic diffusion molecule (carrier) such as a plasticizer in the adhesive of the front part.

With respect to the front parts, typically, all pure acrylic adhesives will dissolve the dyes from migrating inks within hours. Likewise, rubber adhesives are very slow in dissolving migrating inks, taking days, weeks or months to do so.

In order to develop an image within minutes, one simply adds to the adhesive a low molecular weight organic carrier. Plasticizers are excellent carriers. These carriers rapidly dissolve the dyes and cause the color to appear.

For example, a 1 mil acrylic adhesive layer may be used with 5%–10% plasticizer. If it is desired to make the activator cover white, about 15–30% TiO2 may be added to the adhesive. In general, the adhesive is applied as a coating on the substrate. The actual time of image development will depend on the particular dyes that are used. Each dye is different in speed and color intensity. The time can also be controlled by using different plasticizers or other additives. The type of adhesive can also vary the timing.

After activation and the image starts to form, the dyes continue to migrate laterally throughout the adhesive. The more rapid the image appearance, the faster it will diffuse laterally to cause the image to blur. Two methods have been used to prevent blurring. One method involves the use of a patterned adhesive in which each of the discrete adhesive dots traps the dyes and prevent dye mobility to the next adhesive dot, see U.S. Pat. No. 5,058,088 to Haas. Another technique uses dyes that chemically bind to and covalently react with the adhesive directly above the printed image. In using this reacting dye technique, it is preferred to have all the dyes employed react with or bind to the adhesive layer in the same chemical manner. This enables the dyes to react slowly enough to produce sufficient color development, enables the dyes to migrate at similar rates, and assures that the dye color, after reaction, is suitable and stable.

The color intensity of the dyes using a clear adhesive front part is usually very strong. The dye color intensity becomes diluted with the TiO2 within the adhesive when a white adhesive front part is used. The dye color intensity can be increased substantially by employing a clear enhancement layer directly above the white adhesive, into which the dye migrates and leaves the TiO2 behind, see U.S. Pat. No. 4,903,254 to Haas.

It has been found that the time delay before an image appears with migrating inks is proportional to the rate-of-color-change of the image from the first moment it is detectable to 100% of its color development. Thus, if the image first appears (becomes detectable) in 5 minutes after activation, it will usually reach its fill color in about 10–20 minutes. This transition time or "gray time" is usually not a problem with short time intervals, e.g., minutes to hours, but becomes a major problem when the time intervals are weeks or months. If the image first appears in a week, it may take 7 more days before the image reaches 50–100% color development. If one is using this device for its time function, then the observer will have a difficult time deciding if the elapsed time is 7, 8, 9+ days.

With the multiple ink dot printing technique, the printing is by means of patterns of individual ink dots that appear indistinguishable. The ink dots can be printed in uniform or random patterns. The inks are of two types: permanent (non-migrating) inks and migrating inks that develop out the image. The inks should be made from the same vehicle so that their absorption characteristics and reflection properties are identical.

When the adhesive activation cover touches all the ink dots, the migrating ink dots grow in size so that you see an increase in density and/or a color change as the dots become larger. With the opaque cover, the migrating ink dots grow through the opaque material.

Dot printed patterns may be printed on a white (light) background so they can be viewed through a clear adhesive PSA film in which the dots grow in size over the white space (fill-in) to increase the apparent density.

Dot printed patterns may also be printed on a black (dark) background, in which case they must be viewed with a white adhesive PSA film. This is because lateral dot growth over the black space is not directly visible, and the only way to detect the migrating ink is by its appearance through the white adhesive of the activation cover.

The color change (image appearance) occurs when the dyes in the inks migrate into the adhesive itself The dye migration can actually perform two functions:

1) printed dots grow in size and this enlargement is perceived as an increase in the percent tint of the printed area (hence, darkening); and
2) mixed dye colors in the printed ink are selectively absorbed by the adhesive and present themselves as color changes. The ink contains migrating and non-migrating dyes. Since the migrating dye is moving out over the white spaces, its color can be clearly differentiated from the color of the dot itself.

In dot printing the light dot patterns (about 20% tint) have 80% white area around them. Some dots are printed with permanent ink and others are printed with migrating ink. Upon making contact with the adhesive, the migrating dye inks diffuse (bleed) into the pressure sensitive adhesive layer as time passes. The rate of diffusion is dependent on: 1) the particular dye molecule itself, 2) the adhesive composition, and 3) the size of and distance between the dots. The closer together the dots are, the faster they coalesce as the dots grow larger. Thus, these images appear faster. The further apart the dots are, the slower they coalesce and the slower the images appear.

The dot printing technique offers several unique advantages. In particular, using a clear adhesive, information can be made to appear at different rates within the same film when the dots are printed (with the same ink) in different sizes at different spacings. Clear films can be used instead of the opaque films. Clear films offer lower costs film construction and can give multiple colors when one uses different dyes in the various dots.

With the clear barrier ink printing technique, the hidden image is formed by a clear barrier that prevents the adhesive on the activation cover from contacting any of the migrating ink. Thus, the exposed (unprinted) areas of the migrating ink developed into the visible image once the activation cover is applied. The activation cover may employ either clear or white (opaque) adhesive.

If one uses a clear adhesive activation cover, the migrating ink must be printed as a dot pattern with white space between the dots. This will provide white space for the color to develop, causing the white space to turn dark. On the other hand, if the ink is printed as a solid color, the Activation cover must be opaque (white adhesive) in order that the developed color can be seen. There will be little or no contrast if the color development is viewed with the solid ink as the background. In both cases, the clear barrier defines the image that will develop. With white activation covers, the viewer initially sees only the blank white film when the cover is placed over the printing. As the dyes migrate through the white adhesive, one sees the "migrating ink" image on the face of the activation cover. White adhesive images appear uniformly, all at the same time. A barrier can also be incorporated into the adhesive of the front part to block the migrating ink. The migrating ink that passes in regions that it is not blocked will produce the image. This appears to be less practical than employing all the variable designs in the printed back part.

The clear barrier ink printing technique provides the following features:

1) The time is controlled by the dye migration thru the activation cover adhesive only. If dots form the printed migrating ink source of the dye, the dots will continue to grow in size and fill in the white spaces between the dots;
2) A single color (migrating) ink can be used and a single clear barrier (varnish) can be applied over it; artwork registration and the printing is easier than with the multiple ink dot technique;
3) Clear barrier printing cannot provide images that appear at different time intervals because all the ink migrates at the same rate (unless one uses several different dyes for the hidden image printing);
4) white adhesives change color rapidly and provide more contrast than dot printed images; and
5) opaque films provide more attractive blank surfaces for image development than do clear films over dot patterns.

Methods of Concealing Messages in Image Change Paper

Confusion printing is employed to prevent reading of documents or data printed on a different surface below or within the packaging of the article. For example, confusion patterns are printed on the inside of business/pay envelopes to prevent reading the contents through the outer envelope paper and confusion patterns are printed on or within layers of games cards, promotion forms, or lottery tickets. In both of these cases, the printing is with dark ink in specific patterns to prevent reading of numbers and text on subsequent layers within the item itself.

Normally, "unauthorized" reading of the hidden information can be performed with an intense light beam (or other penetrating radiation). Such confusion printing is permanent and not intended to interfere with the actual hidden data itself. For example, the confusion printing on a lottery ticket could be on or within the scratch-off layer of the lottery ticket, so that when this scratch-off layer is removed, the confusion printing is also removed. Also, if the confusion printing is on or within a flap covering the lottery ticket printing, it also is removed at the time the flat is lifted. Likewise, the printing on a business or paycheck envelope is left behind when the actual document or check is removed from the envelope itself. Most, if not all, confusion printing produced on documents has been separate from the printing of the hidden data itself at the time of reading the hidden data.

This is contrary to the confusion printing used in the image change paper of this invention is printed directly over i(in contact with) hidden image itself, and the migrating dyes that form the image in the activation cover must pass through the confusion printing.

There are several embodiments for hiding the image in the image change paper of this invention:

1. Multiple Ink Dot
   Normal Dot Pattern
   Random (Confusion) Dot Pattern
2. Confusion Pattern
   a). Non-Covering Hiding Pattern-patterns, shapes or alphanumeric
   b). Covering
   i) solid opaque
   ii) pattern—random, irregular or even
   iii) partial covering
3. Reactive Dye The following briefly describes each of these confusion techniques.

1). Multiple Ink Dot Printing Technique for Hiding Images

Using dots of the same color, but different inks/dyes within a dot pattern, will conceal which ink dots contain the migrating dyes (black inks eliminate the color matching problem). Dot images created with large white spaces obscure differences in color, position, and texture of the different inks. The latent image is hidden within the dot pattern, awaiting development by the activation (adhesive) cover. The dot pattern can be evenly spaced dots or they can be random. The dots can be all the same or various sizes and shapes. Evenly spaced dots are difficult in the printing process because small registration errors can be detected easily by the eye. Random size and shape dot patterns can tolerate small registration errors without detection by the eye. Mezzotints have been used with great success in hiding the image and ease of printing registration. Random size shapes and dots also provide a confusion pattern within itself and help in hiding the image.

2). Confusion Pattern Printing Technique for Hiding Images

Confusion pattern printing conceals the hidden image by either: 1) printing a solid opaque (colored) ink over the entire hidden image so that nothing is visible below; 2) printing irregular colored confusion shapes over the image so as to hide the migrating ink of the hidden image within the irregular colored printed confusion pattern; 3) printing a more reflective confusion pattern than the contrast differences in the migrating and non-migrating inks used to produce the hidden image. All of these hiding techniques must permit the migrating dyes to pass through to produce the visible image of the hidden image.

Non-covering Hiding Technique

This technique involves concealing the hidden image with a confusion pattern that does not cover or prevent the dyes in the migrating inks from being developed by the activation cover (with or without a carrier).

1. Confusion pattern images that are similar colors or bright reflective patterns will obscure the differences in migrating and non-migrating inks.

2. The printing of irregular colored confusion shapes around the hidden image will hide the migrating ink within the irregular colored printed confusion pattern.

3. Printing a more reflective confusion pattern than the contrast differences between the migrating and non-migrating inks will hide the image.

Covering Hiding Technique

This technique involves concealing the hidden image with an opaque coating or a confusion pattern that covers the migrating inks.

The hidden image printed with migrating ink can be concealed by printing over the migrating image a solid opaque coating or a confusion pattern of various shapes/inks that completely hides the hidden image so that nothing is visible below. The latent image hidden below the obscuring layer(s) is developed by the activation (adhesive) cover by means of an organic diffusion molecule leaving the activation cover and causing the dyes to penetrate the concealing layers.

3). Reactive Dye Hiding Technique

This technique involves hiding dyes in identical colored (colorless) inks and making them appear by reacting with agents in the activation cover.

Reactive migrating dyes hiding in an ink with a non-migrating dye can be made to appear after reacting with chemical components in the adhesive. After reacting, the new form of the migrating dye changes color and a image appears.

Examples of Techniques for Hiding Images

1. Dots of the Same Color

Using dots of the same color, such as black, in different inks will conceal which ink dots contain the migrating dyes. This is because the large white spaces prevent different dots from being compared to one another, and because the large white space tends to conceal mis-registration of the printing. By using black, the color does not have to be closely matched; also, black ink can conceal dyes of different color so that all printed dots look black. By printing the image with a dot pattern that is not a uniform array (with all dots the same size), one can more easily conceal any position, rotation, and dot size variations. In generally, dot printing is performed on a white (light) background, with less than 40 dots per inch. This permits one to use a clear adhesive Activation cover because each dot grows larger over the white background.

2. Employing a Highly Reflective Confusion Pattern over a Matte Dark Background

It has been found that a highly reflectively confusion pattern printed over a black (dark) background with dark inks completely hides the hidden message. The eye sees the bright confusion pattern and cannot detect the faint edges between the migrating and non-migrating inks. I has also been found that these bright confusion patterns can be printed with low concentrations of solids, so that the migrating dyes will pass through the confusion pattern inks. This requires that the background and migrating inks all be dark, and have low reflectivity (matte). It is preferred to use a white adhesive activation cover in order to see the migrating inks in front of the dark background.

3. Printing a Confusion Pattern of Similar Colors over the Hidden Message

One can use the conventional confusion pattern technique of printing irregular patterns over the hidden message, so that the words and letters become obscured by the overprinting, as long as the confusion inks are permeable to the migrating dyes. This is equivalent to the conventional confusion pattern printing except the confusion inks are in direct contact, as remain in place, as the dyes pass through them. It is also important to note that the activation cover must be made with white adhesive in order that the visible confusion pattern not be seen. Literally, the activation cover is "extracting" the hidden image from the mass of printing by means of the migrating dyes.

Certain camouflage techniques are presently not preferred. For example, printing two identical colors to form a solid image. It is almost impossible to print two identical inks in a solid pattern so that one is indistinguishable from the other. It is also very difficult to make their registration so perfect that no edge effects are visible. This is why solid color printing does not work for hiding images. Another technique that is not preferred is printing one or more inks on a dark background.

By printing one or more dark inks on a dark background, one may be able to camouflage the image printed with the migrating ink. However, the slight differences in reflectivity permits a person to see the printing when viewed at a glancing angle. Another technique that is not effective is printing a completely invisible clear barrier over migrating ink Whereas the clear barrier coating may be completely invisible, one can see the unprinted areas within the coating by viewing the printing at a glancing angle. The human eye seems to be able to detect very small differences in reflectivity, probably one-half to one percent. This will make it very difficult to completely conceal the image.

What is claimed is:

1. A game card having a hidden game image thereon that is developed over a predetermined period of time comprising:

a front part and a rear part;

the rear part including:

a migrating ink pattern layer overlaying a rear support member to form a game image;

a non-migrating printed pattern layer overlaying the rear support member to form a confusion pattern to hide the game image;

the front part including a front support layer having an adhesive layer on one side and a front ink display surface on the other side, the adhesive layer capable of causing the migrating ink pattern to migrate upon contact therewith, whereby contacting the front part with the rear part by applying the adhesive layer onto the ink pattern layer activates the migration of ink in a selected time interval from the ink pattern layer, through the adhesive layer to the front ink display surface for viewing the game image.

2. The game card of claim 1, wherein the game card is a lottery ticket and the confusion pattern is an opaque coating covering the image.

3. The game card of claim 1, wherein the front support layer is transparent and the image and confusion pattern can be seen through the support layer.

4. The game card of claim 1, wherein the front support layer is opaque and the image and confusion pattern can not be seen through the support layer.

5. The game card of claim 1, wherein the adhesive includes a plasticizer to rapidly dissolve the migrating ink.

6. The game card of claim 1, wherein the adhesive layer is applied to the support layer as discrete dots of adhesive to thereby minimize lateral dye migration across the surface of the support layer.

7. The game card of claim 1, wherein the front support layer is transparent and the adhesive layer includes titanium dioxide.

8. The game card of claim 1, wherein the migrating ink pattern has a barrier layer overlaying portions of the migrating ink pattern to prevent portions of the pattern from being contacted by the adhesive layer to thereby prevent migration thereof.

9. A game card having a hidden game image thereon that is developed over a predetermined period of time comprising:

a front part and a rear part;

the rear part including:

a migrating ink pattern layer overlaying a rear support member to form a game image;

a non-migrating printed pattern layer overlaying the rear support member to form a confusion pattern to hide the game image;

the front part including a front support layer having an adhesive layer on one side and a front ink display surface on the other side, the adhesive layer capable of causing the migrating ink pattern to migrate upon contact therewith, whereby contacting the front part with the rear part by applying the adhesive layer onto the ink pattern layer activates the migration of ink in a selected time interval from the ink pattern layer across the rear support member to form the game image for viewing through the front ink display surface.

10. The game card of claim 9, wherein the image and confusion pattern comprises a plurality of discrete dots, and upon contact with the adhesive the migrating to form the hidden image migrating ink.

11. The game card of claim 9, wherein the image pattern comprises a plurality of dots and the confusion pattern comprises a plurality of randomly arranged dots, and upon contact with the adhesive the migrating ink migrates to form the hidden image for viewing.

12. The game card of claim 11, wherein substantially all the dots are the same color.

13. A method of playing a game ticket comprising:

providing a game ticket having a hidden image thereon that is developed over a predetermined period of time, the game ticket comprising:

a front part and a rear part;

the rear part including:

a migrating ink pattern layer overlaying a rear support member to form a game image;

a non-migrating printed pattern layer overlaying the rear support member to form a confusion pattern to hide the game image;

the front part including a front support layer having an adhesive layer on one side and a front ink display surface on the other side, the adhesive layer capable of causing the migrating ink pattern to migrate upon contact therewith, contacting the front part with the rear part to thereby apply the adhesive layer onto the ink pattern layer and activate the migration of ink in a selected time interval from the ink pattern layer, through the adhesive layer to the front ink display surface for viewing the game image to determine if it is a winning or losing game ticket.

* * * * *